US008776555B1

(12) United States Patent
Lofgren

(10) Patent No.: US 8,776,555 B1
(45) Date of Patent: Jul. 15, 2014

(54) SAFETY LOCKING HANDCUFFS

(71) Applicant: Matthew S. Lofgren, Hollywood, FL (US)

(72) Inventor: Matthew S. Lofgren, Hollywood, FL (US)

( * ) Notice: Subject to any disclaimer, the term of this patent is extended or adjusted under 35 U.S.C. 154(b) by 81 days.

(21) Appl. No.: 13/716,502

(22) Filed: Dec. 17, 2012

Related U.S. Application Data

(63) Continuation-in-part of application No. 12/848,667, filed on Aug. 2, 2010, now Pat. No. 8,353,183, and a continuation-in-part of application No. 12/468,421, filed on May 19, 2009, now abandoned.

(60) Provisional application No. 61/092,747, filed on Aug. 28, 2008.

(51) Int. Cl.
*E05B 75/00* (2006.01)

(52) U.S. Cl.
USPC ..... 70/16

(58) Field of Classification Search
CPC ..... E05B 75/00; E05B 73/00; E05B 73/02; E05B 73/0041; E05B 67/28; E05B 67/32
USPC ..... 70/14–17, 234, 455
See application file for complete search history.

(56) References Cited

U.S. PATENT DOCUMENTS

| | | | | | |
|---|---|---|---|---|---|
| 1,890,748 | A * | 12/1932 | Pratt | ..... | 70/16 |
| 2,516,878 | A * | 8/1950 | Howe | ..... | 70/16 |
| 2,772,553 | A * | 12/1956 | Howe | ..... | 70/16 |
| 2,948,139 | A * | 8/1960 | Howe | ..... | 70/16 |
| 4,138,867 | A * | 2/1979 | Tompkins | ..... | 70/16 |
| 6,588,240 | B2 * | 7/2003 | Anderson | ..... | 70/16 |
| 8,336,345 | B2 * | 12/2012 | Burgoon | ..... | 70/16 |
| 8,353,183 | B1 * | 1/2013 | Lofgren | ..... | 70/16 |
| 2013/0333425 | A1 * | 12/2013 | Krelle | ..... | 70/16 |

* cited by examiner

*Primary Examiner* — Christopher Boswell
(74) *Attorney, Agent, or Firm* — Gold & Rizvi, P.A.; Glenn E. Gold

(57) ABSTRACT

A handcuff assembly comprising a pair of handcuff bodies retained to one another by one or more linkages. Each body extends between a pivot end and a body latching end. A locking arm is pivotally assembled to the handcuff body pivot end. A series of ratcheted teeth extend along a portion of each locking arm proximate an arm latching end. A first locking pawl is integrated into each handcuff body, wherein the first locking pawl is operated by a key to engage the pawl with the ratcheted teeth, retaining the handcuff assembly in a locked configuration. A second locking mechanism is provided at the pivot assembly, wherein the second locking mechanism resists pivotal motion of the locking arm when oriented into a locked configuration by way of rotating a key. The handcuff assembly requires rotation of two separate locking mechanisms by two separate key motions to unlock each locking arm.

20 Claims, 10 Drawing Sheets

SAFETY LOCKING HANDCUFFS

CROSS REFERENCE TO RELATED APPLICATIONS

This application is a Continuation-In-Part Application claiming the benefit of U.S. Non-Provisional Utility application Ser. No. 12/848,667, filed on Aug. 2, 2010, which is a Continuation-In-Part claiming benefit from U.S. Non-Provisional Utility application Ser. No. 12/468,421, filed on May 19, 2009 (currently abandoned), which claims the benefit of U.S. Provisional Patent Application Ser. No. 61/092,747, filed on Aug. 28, 2008 (now expired), all of which are incorporated herein in their entireties.

FIELD OF THE INVENTION

The present disclosure generally relates to improvements in handcuff safety or efficacy, and more particularly to handcuffs having an additional and improved locking mechanism design.

BACKGROUND OF THE INVENTION

Handcuffs are used by various parties, such as law enforcement officers, corrections, security, military, and the like, to restrain an individual for any reason, such as suspicion of a crime, a potential for physical violence, uncertain mental health conditions, under the influence of a substance, and the like. Such restraint is necessary to maintain control of the subjects and to prevent the subject from possibly escaping or causing injury to others or themselves. Standard handcuffing protocol sets forth that the subject be handcuffed with his/her hands behind his/her back for many reasons. One reason for positioning the hands behind the back of the individual is that it may improve the safety of others or themselves by limiting the movement and mobility of the individual. Another reason is to prevent the individual from attempting to pick the lock mechanism while placing or holding a key or picking device in his/her mouth. Still, another reason for handcuffing behind the back is that this position may make it more difficult for the individual to attempt to defeat or pick the lock with any object that he/she may have access to (e.g., a stationary sharp or pointed object) or to try to break the attachment or connection between the two handcuffs. Yet, another reason, is that such position may prevent the individual from having a visual or view of the location of a lock or keyhole on the handcuff, thus making lock manipulation or picking more difficult. Additionally, subjects are more limited when their hands are placed behind their back. The subject's ability to run and general mobility and use of their hands/arms are all limited. Typically, the keyhole or lock is exposed on the "up" side of the handcuff away from the individual's fingers. Having one-sided access to the lock or keyhole makes it more difficult for the individual to access the keyhole. For example, it may be more difficult for the individual to place or position an object in or around the keyhole when it is located on the "up" side. That is, the "up" side of the handcuffs is more obstructed by the individual's wrists, arms and/or body whereas the "bottom" side placement is only obstructed by his/her fingers.

While conventional handcuffs have proven satisfactory, the locks of these traditional handcuffs are vulnerable to unauthorized opening because (i) they may be picked by one who has access to a picking device; (ii) it is possible for the lock to be opened by one who has gained unauthorized access to a key; (iii) they could be opened by forcefully jarring or pressing down on the locking plate when the handcuffs are not double locked, (iv) handcuffs, regardless of type, generally utilize a universal key, which could be carried by any individual, and (v) some models of handcuffs include keyholes on both sides, allowing the restrained individual to access the key opening more easily. Because prior art locking mechanisms locate the locks in the middle of the handcuff assembly (i.e., at a base portion of each handcuff in the handcuff assembly), between the handcuff shackles, an individual wearing the handcuff assembly may be able to reach the lock with his/her fingers or with a key or pick device in his/her mouth and proceed to pick or open the lock(s). The proximity of the locks to the individual's fingers poses an immediate possible threat to the safety of the personnel responsible for the control and custody of the individual, and ultimately to the safety of the general public. This threat can be at least partially minimized by orienting the handcuffs so that the lock keyhole to the locks is oriented away from the wearer's fingers. However, determining such orientation without a distinctive orientation feature is difficult when the handcuffs are applied in a stressful environment such as at initial apprehension of a suspected perpetrator.

Another contributing element enabling the individual restrained by the handcuffs to access the lock keyholes is the design, length and flexibility of the intermediary segment retaining the two bracelet sections attached to one another. The intermediary segment needs to be flexible enough to provide a reasonable amount of limited movement to the individual's wrists and arms to ensure comfort while providing safety to the law enforcement personnel. The greater the flexibility of the intermediary segment, the higher the risk for escape.

Accordingly, there has arisen a need to provide in a handcuff of this type additional protection against picking or opening the handcuff lock.

The death or injury of law enforcement operators is unfortunate, especially when due to a prisoner "picking" handcuffs or to handcuff restraint malfunction, or gaining access to a key. In 2002, two Tampa, Fla. detectives were investigating a suspect when the suspect escaped his handcuffs and murdered the detectives. The suspect was carrying his own handcuff key. This suspect later hijacked a truck, killed a pursuing Florida Highway Patrol (FHP) Officer, and then, after a hostage standoff, the suspect killed himself. If the suspect had not escaped his handcuffs, then the three law enforcement operators might be alive today. Accordingly, law enforcement operators have a need for more secure handcuffs that are quickly deployed to secure about the wrists of a suspect as well as handcuffs that are less susceptible to picking and/or malfunction.

SUMMARY OF THE INVENTION

The aforementioned problems, and other problems, are reduced, according to exemplary embodiments, by methods, systems, or an apparatus that incorporates improvements in handcuff safety or efficacy, and more particularly to a pivot lock handcuff assembly having an additional and improved locking mechanism design proximate to the pivot point of the shackle or to the locking arm.

One aspect of the present invention is a handcuff that includes a body defining an interior cavity and having upper and lower parallel strands extending laterally from the body and terminating at a pivot end. A primary locking mechanism is supported within the interior cavity and includes a pawl having ratcheted teeth for selectively capturing oppositely oriented ratcheted teeth. A locking arm having a free end and a pivot end is pivotally affixed to the pivot end of the upper and lower parallel strands. The locking arm further includes a plurality of ratcheted teeth at an outer edge of the free end for selective engagement with the pawl ratcheted teeth. A pivot locking mechanism is positioned at the pivot end of the strands for selective engagement to prevent pivoting of the locking arm with respect to the body.

Another aspect of the invention is a handcuff including a body having a set of substantially planar cheek plates lying in substantially parallel planes. A locking arm has a pivot end pivotally connected to the body and is selectively positionable at a first mated, lockable portion of the body and a free end selectively positionable at a second mated, lockable portion of the body. The locking arm also has a concave engaging surface. A primary locking mechanism is located on the body for receiving the free end of the locking arm and defines a first keyhole into a first keyway for accessing a first locking position of the free end of the locking arm. The primary locking mechanism further includes a pawl positioned within the body and has pawl teeth, wherein the free end of the locking arm includes opposing ratchet teeth for engaging the pawl teeth. A pivot locking mechanism is located on a shackle portion proximate to a pivot point connecting the locking arm with the body. The pivot locking mechanism defines a second keyhole into a second keyway for accessing a second locking position of the pivot end of the locking arm. The pivot locking mechanism also has a pawl positioned within the second mated, lockable portion of the body and includes pawl teeth, wherein the pivot end of the locking arm further includes an inner surface portion having ratcheted teeth for engaging the pawl teeth of the second mated, locked portion of the body.

Yet another aspect of the invention is a method for using a triple locking handcuff assembly of two interconnected handcuffs. Each handcuff is of the type including a body having a set of substantially planar cheek plates lying in substantially parallel planes and having a locking arm comprising a pivot end pivotally connected to the body. The locking arm is selectively positionable at a first mated, lockable portion of the body and a free end selectively positionable at a second mated, lockable portion of the body and also has a concave engaging surface. The handcuff further has a primary locking mechanism located on the body for receiving the free end of the locking arm, the second locking mechanism defining a first keyhole into a first keyway for accessing a first locking position of the free end of the locking arm, the primary locking mechanism further comprising a pawl positioned within the body and including pawl teeth, wherein the free end of the locking arm includes opposing ratchet teeth for engaging the pawl teeth. A pivot locking mechanism is located on a shackle portion proximate to a pivot point connecting the locking arm with the body, the pivot locking mechanism defining a second keyhole into a second keyway for accessing a second locking position of the pivot end of the locking arm, the pivot locking mechanism further comprising a pawl positioned within the second mated, lockable portion of the body and including pawl teeth, wherein the pivot end of the locking arm further includes an inner surface portion having ratcheted teeth for engaging the pawl teeth of the second mated, locked portion of the body. The method includes the steps of positioning a first handcuff of the triple locking handcuff assembly on a first wrist of an individual, then locking the first locking mechanism of the first handcuff. Then either a second handcuff can be positioned on a second wrist of the individual and the first locking mechanism of the second handcuff is locked or the second locking mechanism of the first handcuff is then locked. If the second handcuff is positioned on the second wrist immediately after application of the first handcuff on the first wrist, then once both first locks of the first and second handcuffs are positioned, the second locks on each of the first and second handcuffs can be engaged. If the second locking mechanism of the first handcuff is locked prior to positioning of the second handcuff on a second wrist, a second handcuff of the triple locking handcuff assembly is positioned on a second wrist of the individual whereupon the first locking mechanism of the second handcuff is locked and then the second locking mechanism of the second handcuff is locked. Each of the first locking mechanisms locks automatically during the clasping process. If kept in the locked position, the pivot locks will engage automatically and manual application is not required.

According to other aspects, the pivot lock is difficult to access by the individual wearing the handcuffs. The pivot locks work by preventing the shackle to open or release unless each pivot lock is unlocked in addition to the unlocking of the traditional lock—that is, both the pivot lock and the traditional lock must be unlocked. The innovative placement of each pivot lock prevents the individual from picking or opening the handcuff, thereby requiring assistance to remove. Without inflicting injury to the individual, the triple locking handcuff restricts the movement of the wrists and hands of the individual and places each pivot lock so far out of reach of the individual's fingers that the pivot lock cannot be unlocked or picked open, without assistance from a second individual. Additionally, each of the pivot locks for the triple locking handcuff assembly must be opened or otherwise defeated along with each of the conventional locks (proximate to the base plate) in order for the individual to be able to escape. Accordingly, the pivot lock supplements and strengthens the conventional lock and security of the handcuff design.

According to additional aspects, a portion of the locking arm, one side of the double strand, and the connection of the two are modified to incorporate the pivot lock. This modification will result in a set of handcuffs that are slightly thicker but not wider, than traditional handcuffs. This small increase in size will not compromise the standard regulation carry because the improved handcuffs will fit in exactly the same manner and space on an officer's uniform (typically along the belt) as traditional handcuffs, the only difference will be that the improved handcuffs will extend away from the body slightly because of the increased width that accommodates the additional locks.

In yet more aspects, the portion of the locking arm at the pivot point incorporates ratcheted teeth that mate with one or more grooves of the locking mechanism to facilitate adjustment in positioning of the locking arm to fit the wrist of the individual wearing the triple locking handcuffs. When the pivot lock is locked into position, the mated ratcheted teeth are secured in position until unlocked with a key. According to additional aspects, the triple locking handcuffs may incorporate standard locks appropriate for the ratcheted teeth and grooves.

According to further aspects, the pivot locks may be protected by a spring loaded or sliding keyhole cover to restrict access to the keyhole. The cover may be manually or automatically deployed to cover the opening to the keyhole of the pivot lock and provides additional security to the lock mechanism of the pivot lock. This cover adds security because it must be moved out of the way or if it is spring-loaded it must be held out of the way while the pivot lock is accessed or manipulated. This keyhole cover provides additional protection from foreign materials entering and or interfering with the locking mechanism of the pivot lock.

According to still further aspects, the triple locking handcuffs may also incorporate touch verifiable alignment features, such as a raised bump on the "up" side of the base portion of each handcuff as well as a complimentary depressed smooth dimple or indentation on the "bottom" side of the corresponding base portion of the handcuff. Alternate embodiments may incorporate additional alignment features, such as color-coding a portion of the cuff to indicate proper orientation (i.e., "up" or "down" orientation). Such markings allow the operator to orientate proper placement by either touch, feel, or both; without needing visual inspection during cuffing.

Another aspect includes a method of using the triple locking handcuff that incorporates the pivot lock, the alignment features, and/or the protective pivot lock cover.

Yet another aspect of the invention is a pivot lock for use in a handcuff of the type having a body containing a primary locking system and having parallel strands extending laterally therefrom terminating at a pivoting end, which supports a pivoting locking arm with a plurality of ratcheted teeth for engaging the primary lock. The pivot lock is positioned at the pivoting end and includes a pivot gear affixed to the locking arm at a pivoting juncture of the strands and the locking arm. The pivot gear has a plurality of teeth about its periphery. A locking pawl has at least one detent and a projection therefrom and is supported by one of the parallel strands. The locking pawl is selectively rotatable between a locked position wherein the projection is in engagement with the plurality of teeth of the pivot gear and an open position wherein the projection is disengaged from the plurality of teeth. A plunger engages the at least one detent for maintaining the locking pawl in a selected rotated position.

Still another aspect of the present invention is a handcuff having a body defining an interior cavity and having upper and lower parallel strands extending laterally from the body and terminating at a pivot end. A primary locking mechanism is supported within the interior cavity and includes a pawl having ratcheted teeth for selectively capturing oppositely oriented ratcheted teeth. A locking arm has a free end and a pivot end pivotally affixed to the pivot end of the upper and lower parallel strands. The locking arm further includes a plurality of ratcheted teeth at an outer edge of the free end for selective engagement with the pawl ratcheted teeth. A pivot locking mechanism is positioned at the pivot end of the strands for selective engagement to prevent pivoting of the locking arm with respect to the body. The pivot locking mechanism further comprises a pivot gear having a plurality of teeth about a periphery thereof affixed to the locking arm at a pivoting juncture of the strands and the locking arm. A locking pawl having at least one detent and a projection therefrom is supported by one of the parallel strands. The locking pawl is selectively rotatable between a locked position wherein the projection is in engagement with the plurality of teeth of the pivot gear and an open position wherein the projection is disengaged from the plurality of teeth. A plunger engages the detent for maintaining the locking pawl in a selected rotated position.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE DRAWINGS

The invention will now be described, by way of example, with reference to the accompanying drawings, where like numerals denote like elements and in which.

Like reference numerals refer to like parts throughout the several views of the drawings.

DETAILED DESCRIPTION OF THE PREFERRED EMBODIMENT

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Exemplary embodiments of the triple locking handcuff incorporate a pivot lock that is located proximate to a top, outer edge of each shackle, in the position farthest away from the fingers of an individual wearing the triple locking handcuffs. The pivot locks supplement or otherwise increase security of prior art handcuff assemblies because each triple locking handcuff now has an additional pivot lock on each handcuff. The pivot locks work by preventing movement of the locking arm and maintains the cuffs in a locked position. In addition, the placement of each pivot lock prevents or otherwise significantly reduces the ability of the individual to pick or otherwise open the lock and requires assistance of a second individual to unlock the pivot locks. The various embodiments described herein may be constructed of steel, titanium, nickel, composites, and/or other materials that meet or exceed all National Institute of Justice (NIJ) standards (NIJ Standard-0307.01) and testing requirements or other equivalents.

Figure 1:
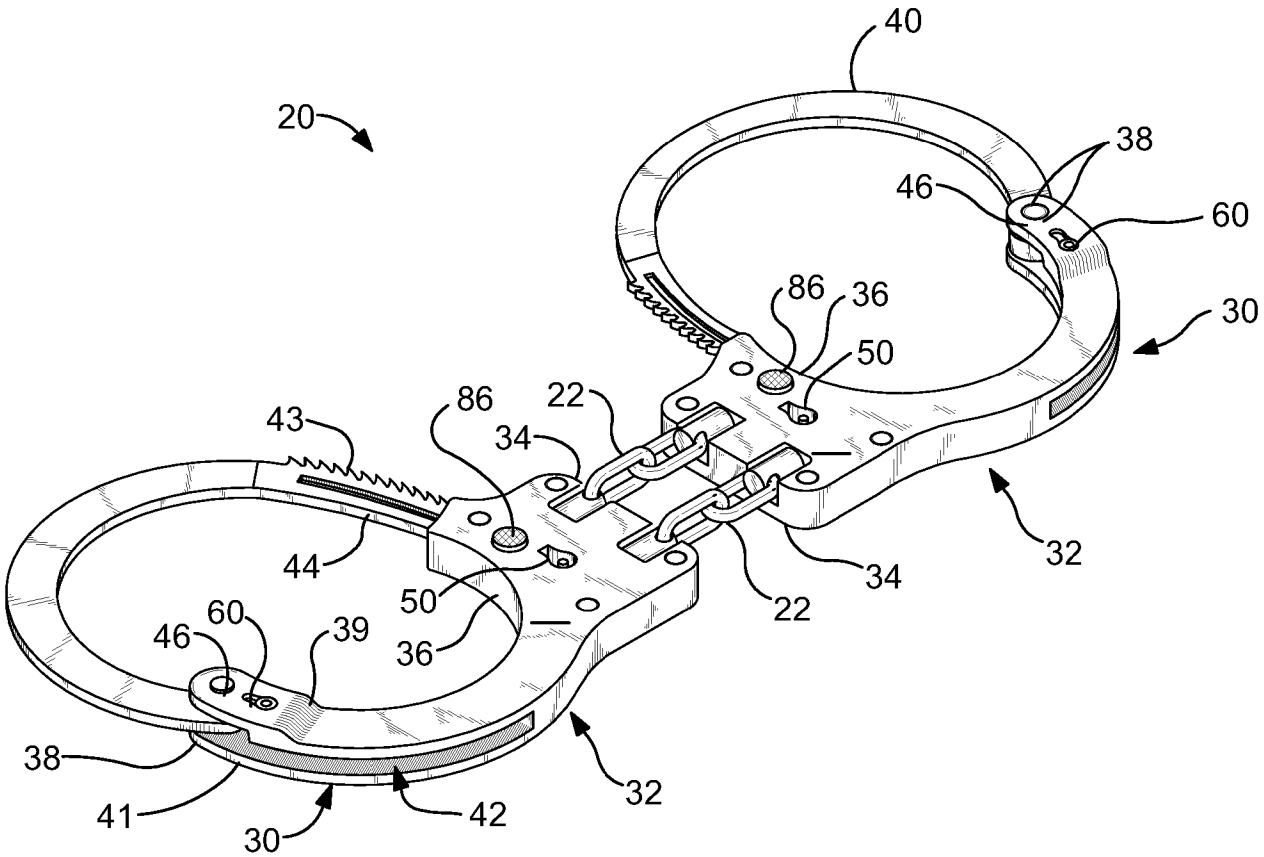
FIG. 1 is a top perspective view of a handcuff assembly illustrating the location of the pivot locks according to an exemplary embodiment of the invention.

Referring now to the drawings, FIG. 1 illustrates a perspective top view of a triple locking handcuff assembly 20 that includes a pair of left and right handcuffs 30, each having a body portion 32 also referred to as a shackle. Left and right handcuffs 30 are mirror image constructions one of the other and are herein referred to interchangeably. Left and right shackles 32 are interconnected by one or more linkages 22 attached to an inner edge 34 of shackles 32. Each handcuff shackle 32 defines an interior cavity which supports a first primary locking mechanism 50 located at a base plate 36 and a pivot locking mechanism 60 located proximate to a pivot end 38 of shackle 32. Pivot end 38 includes an upper strand 39 and a lower strand 41 defining a slot 42 therebetween and to which is pivotally affixed a single strand locking arm 40 such that locking arm 40 is captured between strands 39 and 41. Locking arm 40 includes ratcheted teeth 43 at a free end 44 thereof. Ratcheted teeth 43 engagingly mate with a pawl assembly (not shown) within base plate 36 and also having oppositely oriented ratcheted teeth (not shown). Such use and configuration of ratcheted teeth in combination with the primary lock 50 of handcuff assembly 20 is well known in the art and is thus not described further herein. The primary lock 50 is commonly designed to meet existing and/or future National Institute of Justice (NIJ) standards or their equivalent.

Figure 2:
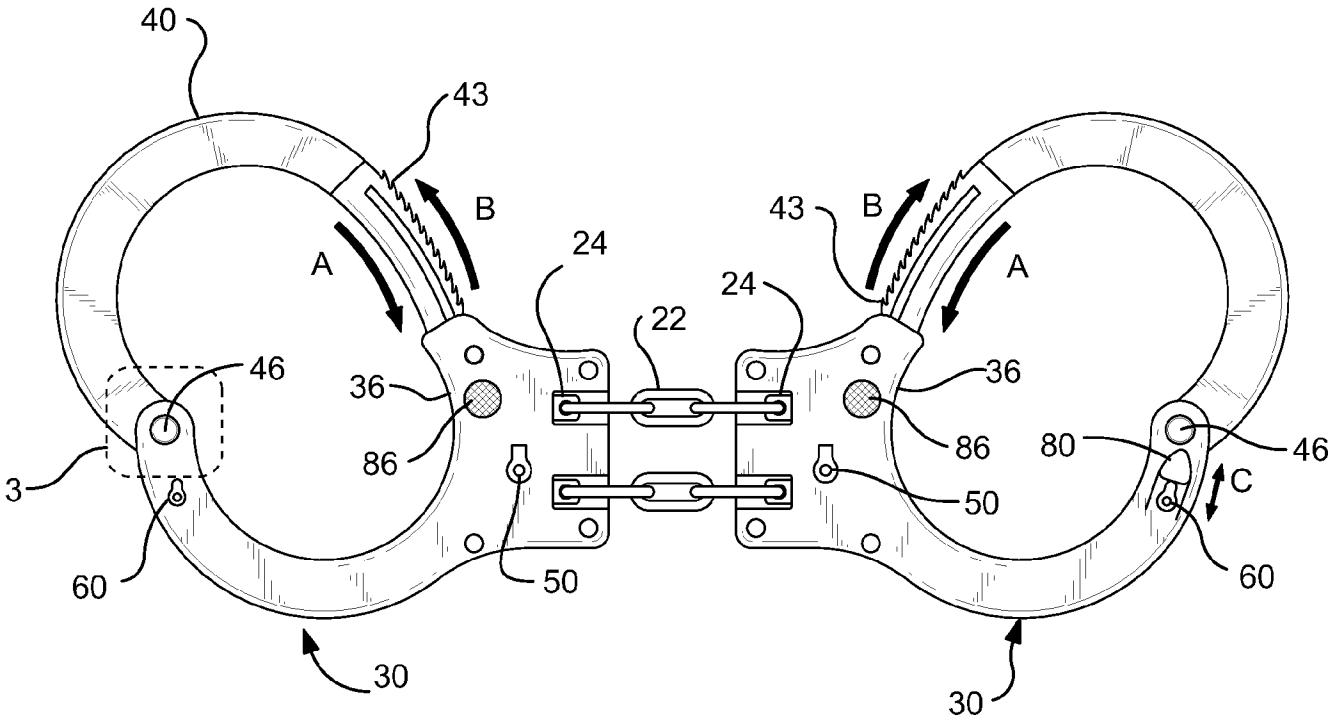
FIG. 2 is a top view of the handcuff of FIG. 1 illustrating the cuff body, the pivot point, and the locking mechanism according to an exemplary embodiment of the invention.

According to exemplary embodiments, the primary locking mechanism 50 is only accessible on one side—that is, the "top" side as illustrated in FIG. 2. The placement of the primary locking mechanism 50 corresponds with the orientation and placement of the known prior art handcuff locks. Key orientation of primary locking mechanism 50 is also similar to conventional handcuff locking mechanisms known in the art. While primary locking mechanism 50 automatically reverts to a locked state (allowing the capture of ratchet teeth 43 by the internal pawl) upon removal of the key, pivot lock 60 may be configured to stay in the open position when unlocked. It is understood that while FIG. 2 illustrates the primary locking mechanism 50 on the "top" side, the primary locking mechanism 50 may be oriented on the opposing side, that is, the "bottom" side in another embodiment.

As illustrated in FIG. 2, locking arm 40 pivots about hinge 46 and rotates towards base plate 36 as indicated by arrow 'A' to engage ratcheted teeth 43 with the mating pawl in base plate 36. To release locking arm 40, primary locking mechanism 50 and pivot lock 60 are both disengaged permitting locking arm 40 to rotate about hinge 46 in an opposite direction as indicated by arrow 'B'.

Figure 3:
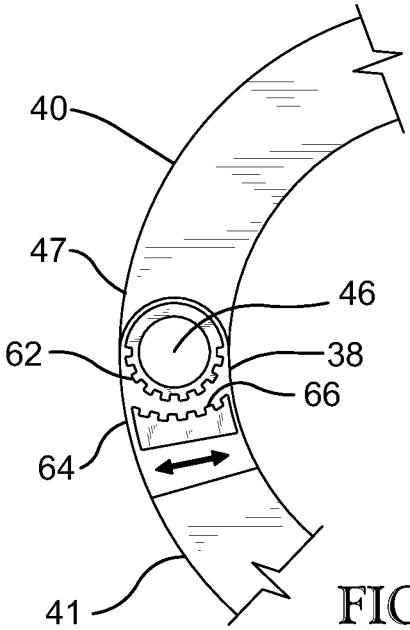
FIG. 3 is an enlarged top segmental view of a pivot lock of the handcuff of FIG. 2 and shown by the enclosed area 3 of FIG. 2.
Figure 4:
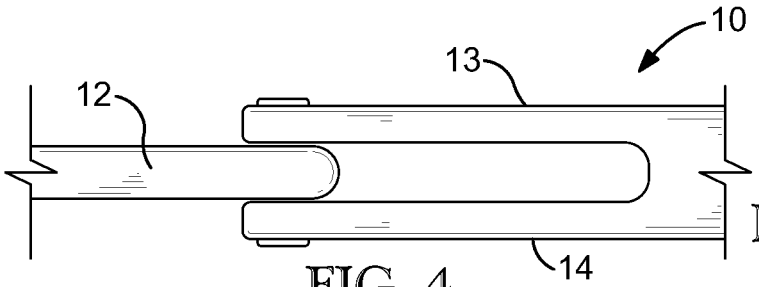
Prior Art FIG. 4
FIG. 4 is an elevation view of a prior art pivot joint portion of a handcuff.
Figure 5:
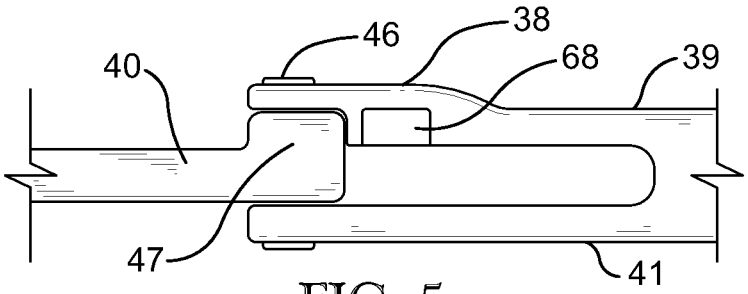
FIG. 5 is an elevation view of the pivot joint portion of the handcuff of FIG. 2 according to an exemplary embodiment of the invention.

FIGS. 3-5 illustrate an embodiment of a pivot lock 60 wherein FIG. 3 shows a top cut away view of the exemplary embodiment of pivot lock 60 in upper strand 39. As illustrated, handcuff assembly 20 includes pivot locks 60 at each pivot end 38 of shackles 32 to prevent the handcuff 30 from being opened or released unless manually unlocked or otherwise disengaged. Referring to FIG. 3, a pivot end 47 of locking arm 40 is affixed to pivot end 38 of shackle 32 at hinge 46. Pivot end 47 includes a plurality of locking arm teeth 62. Upper strand 39 of shackle 32 defines a recess 68 housing a locking pawl 64 of pivot lock 60. Locking pawl 64 includes pawl teeth 66 configured such that pawl teeth 66 interengage with locking arm teeth 64 when locking pawl 64 is translated from an 'open' position to a 'locked' or engaged position. Locking pawl 64 can be translated to an engaged position by either a spring or by a key activated mechanism within recess 68.

Pivot lock 60 incorporates a push-pin or slot-activated mechanism that is similar to the double locking feature incorporated in prior art primary locks 50. When engaged, this mechanism stops the cuff 30 from ratcheting tighter, thereby protecting an individual from laceration, or decreased circulation, reducing the potential for unwanted opening, and reducing the likelihood of having to re-open a triple handcuff assembly 20 for further adjustments (e.g., placed too tight on the wrists of an individual wearing the handcuffs). This feature thereby introduces yet another level of protection from unauthorized and avoidable opening. The deadbolt style design does not allow movement in any direction, either tighter or looser. In addition to using a spring design similar to prior art handcuff locks; the pivot lock 60 may also incorporate a standard double locking mechanism (Reference FIG. 6). The pivot lock 60 uses the same universal handcuff key as used in the primary lock 50. However, the pivot locks 60 can also be configured to use high-security keys or other key types. If primary lock 50 is double locked, handcuff 30 will not tighten and there is no need to engage a second double lock on pivot lock 60 to prevent tightening. However, security would be improved by engaging the double lock on both the primary lock 50 and pivot lock 60 thereby limiting movement of the lock elements making the mechanism tighter.

The pivot lock 60 differs from conventional locks in that once unlocked or released, the pivot lock 60 remains in the open or released position (in the same way a car door lock would). Such design allows an operator (e.g., law enforcement personnel) to then remove the key and unlock each pivot lock 60 along with each primary lock 50 to release an individual wearing the triple locking handcuff assembly 20. This is achieved by a second spring or mechanism holding the lock open or unlocked. The operator can then unlock the primary lock 50 that is under constant tension. Once the individual wearing the triple locking handcuff assembly 20 is released, the operator then resets the pivot lock 60 with the key. To reset, the operator inserts the key into the pivot lock 60 and turns it, thereby releasing the mechanism or the spring holding it in the open or unlocked position. The primary spring holds the mechanism in the locked or closed position. The pivot lock 60 can also be automatically re-set or re-locked by cycling cuff 30 or pushing the single strand locking arm 40 through the cuff body. There may be multiple resets that would engage upon fully opening or reclosing the handcuff.

As illustrated in FIGS. 1-2, attachment of one handcuff 30 to an opposite handcuff 30 is illustrated as a chain-link design. It is understood that handcuff to handcuff coupling configuration can be utilized, such as a hinged design and the like. According to some embodiments the coupling configuration secures the individual's hands in a parallel position one to another and may provide further security and safety by restricting movement of the hands. The chain-link design of the attachment attaches to the handcuff 30 via two or more hinges 24. Alternate attachment may also include connecting a pair of triple locking handcuffs 30 with a link, a cable, or a blocked, rigid handcuff assembly (all known in the art). The blocked, rigid style assembly (not shown) can include a fixed plastic or metal block between the handcuffs. While such a blocked, rigid design is bulkier for an individual to carry, it prevents rotation of the cuffs, and permits several variations in cuffing, such as, for example, with one hand cuffed, an individual wearing the one cuff may be controlled or otherwise restrained.

FIGS. 1-2 illustrate the triple locking handcuff assembly 20 with additional features that provide ease of orientation and increased security. The pivot lock 60 may also incorporate a sliding cover 80 to protect the lock 60 from being picked and from collecting debris. As appreciated by one of ordinary skill in the art, the cover 80 could be moved manually or spring loaded. In addition, handcuffs 30 may further incorporate touch verifiable markings such as raised surface 86 for easy orientation. Raised surface 86 may be stippled or otherwise have frictional markings that may be used to denote the "up" or "top" side for proper cuff orientation. Still, further exemplary embodiments may incorporate color-coding of surface 86 to denote proper orientation.

Figure 6:
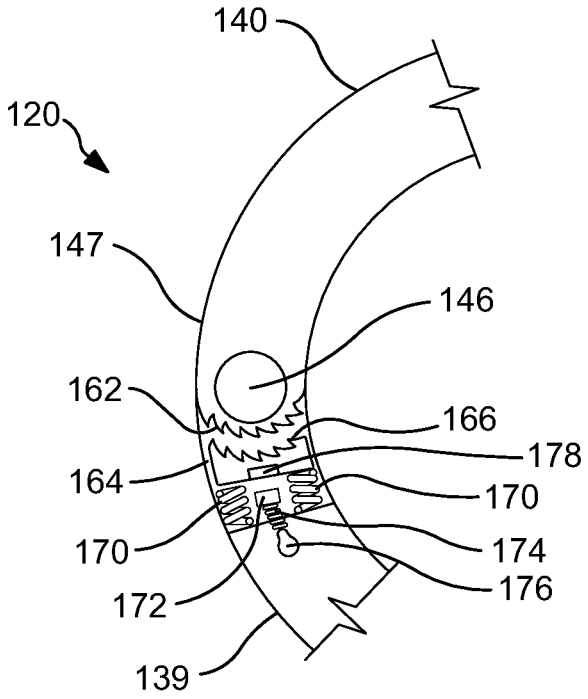
FIG. 6 is an enlarged top segmental view of an alternate embodiment pivot lock of the handcuff.

An alternate embodiment handcuff assembly 120 similar to handcuff assembly 20 with an alternate embodiment pivot lock 160 is illustrated in FIG. 6. Handcuff assembly 120 includes a locking arm 140 pivotally affixed to strands 139 and 141 at hinge 146. Pivot end 147 of locking arm 140 is configured to include ratchet teeth 162. Upper strand 139 defines a recess in which is housed locking pawl 164. Locking pawl 164 includes ratcheted pawl teeth 166 configured such that ratcheted pawl teeth 166 interengage with locking arm ratcheted teeth 162. The location of the locking teeth 162, 166 corresponds with the locking of the ratchet teeth in the prior art primary lock 50 (i.e. they both lock at the same time when the cuff is closed, the pivot locks will not engage or lock when the cuff is open). For example and as illustrated in FIG. 1, ratcheted teeth 43 at the free end 44 of the locking arm 40 engage the pawl in the primary locking mechanism 50 at base plate 36. Referring again to FIG. 6, ratcheted teeth 166 of locking pawl 164 are biased against ratcheted teeth 162 of locking arm 140 by compression springs 170. A key (not shown) is utilized to selectively activate a locking cam 176 which in turn causes a dead bolt 172 to engage and disengage from a recess 178 in pawl 164. Engagement of dead bolt 172 in recess 178 prevents teeth 162 and 166 from ratcheting with respect to each other, thus providing a third lock of handcuff assembly 120. Subsequent activation of locking cam 176 with the key will overcome compression springs 170 and 174 to withdraw deadbolt 172 and pawl 164 allowing the rotation of locking arm 140 to place handcuff assembly 120 in an 'open' condition.

A raised index or reset mechanism on the pivot end 147 of locking arm 140 releases the lock mechanism from the open position in the same way that the key does and releases the lock to return to the locked position. The raised index is located on the ratchet teeth 162. This ensures that the handcuff is returned to the locked position before the cuff is closed when the ratchet teeth 162 first come in line or contact with the pivot lock mechanism 160. The raised index effectively reactivates the lock before the cuff is placed in the closed position. The ability to reset the mechanism with the key is necessary in the event that the operator unlocks a cuff 130 to loosen or adjust it. In instances when a cuff 130 is being loosened or adjusted, the locking arm 140 will not be cycled through so the raised index will not re-lock the cuff or reset pivot lock mechanism 160. When the cuff 130 is being loosened the operator must re-lock the pivot lock 160 (when the design in use is not one under constant spring tension). In alternate exemplary embodiments, the pivot locks 160 are under constant spring tension similar to the primary lock mechanism 50 and a key must be inserted and turned and held in place while the cuff is being opened. This is necessary to overcome the spring tension that holds the pivot lock mechanism 160 in place or locked. If such a pivot lock 160 were utilized, it would then require the operator or operators to simultaneously unlock both locks 50, 160 (with two keys) while releasing the triple locking handcuff assembly 120. Such a configuration may be desirable in high security environments.

One of the advantages of handcuff assembly 20 including pivot lock 60 is increased security when the triple handcuff assembly 20 is used to restrain individuals having large wrists. That is, for individuals having large wrists, only one or two teeth 43 of locking arm 40 may engage the locking assembly of each handcuff 30. By locking the pivot locks 60, the triple handcuff assembly 20 provides an additional locked position that prevents movement of locking arm 40 if primary locking mechanism 50 fails.

FIGS. 4 and 5 illustrate side elevation views of a prior art handcuff 10 (FIG. 4) and triple locking cuff assembly 20 (FIG. 5). Prior art handcuff 10 has a locking arm pivotally captured between an upper strand 13 and lower strand 14. The body and operation of a primary locking mechanism is as previously disclosed and known in the art. For the safety locking handcuff 20 the pivot lock 60 prevents the locking arm 40 from opening or unlocking unless unlocked. Furthermore, the pivot end 47 of the locking arm 40 is oversized to incorporate locking arm teeth 62. This oversized body design allows the locking arm 40 to rotate and operate in a similar manner as the conventional handcuff. That is, the pivot lock 60 does not interfere with the range of motion or the cycling of the locking arm 40.

Typically, the pivot end 47 is of a greater height than in conventional handcuffs (see representative height of arm 12, FIG. 3). Enlarged pivot end 47 permits the pivot lock 60 to function in the same manner as the traditional design. According to exemplary embodiments, the pivot end 38 of strand 39 of the handcuff body 32 is enlarged to accommodate the pivot lock mechanism 60. According to additional exemplary embodiments, locking arm teeth 62 are raised or extend out further than the pivot point hinge 46. This allows the locking arm teeth 62 to engage pivot lock mechanism 60 (e.g., a pawl component 64). When the teeth 62 are not engaged or when the handcuff 30 is open there is no engagement or friction. This allows the handcuff 30 to rotate freely or unobstructed when pushed, similar to prior art handcuffs. Teeth 62 may be a full gear with gearing all the way around the pivot or in other designs, a gear in sections, corresponding with the orientation of the primary lock mechanism 50.

According to exemplary embodiments, the opening or access to the pivot lock 60 is located on the topside of the handcuff. Preferably, the keyhole is not open or otherwise accessible on the bottom side. Furthermore, the orientation and positioning of the keyholes for each pivot lock 60 in the assembly 20 is oriented similarly with complimentary orientation on the topside.

According to still further exemplary embodiments, when the locking arm 40 is positioned through or in the open position, the locking arm teeth 62 on the pivot end 47 are not engaged with pawl 64. This allows the handcuff to rotate freely in a similar manner as prior art handcuffs by not creating any drag or obstruction. This lock configuration on the pivot end 47 further allows the handcuff to be closed or tightened and does not allow the handcuff to be opened or loosened when applied to an individual until it is unlocked. It will however allow the locking arm 40 to be pushed through or tightened as it would in the prior art handcuff assemblies. Pushing through occurs when the handcuffs are not applied to an individual or are empty. When empty there is no wrist in the way and the cuff rotates or pushes through the locking body in a forward motion.

The pivot locks 160 with ratcheted teeth 162 permit pushing through but not pulling back in the same manner as primary locks 50 operate and facilitate "speed-cuffing". "Speed-cuffing" occurs when the operator places or pushes the cuff against the individual's wrist with a force that will allow the locking arm to push through or cycle. When the handcuff cycles through it then locks once it encircles the individual's wrist and reaches the locked position. This method is quicker than opening the handcuff with a key and then encircling the individual's wrists. The "spring loaded" variation of the exemplary embodiment would still allow for "speed-cuffing" because the second pivot lock could engage automatically without the use of a key but would require a key to unlock, thereby adding increased security.

According to an exemplary embodiment, the triple locking handcuff assembly 20 may be constructed of steel, titanium, nickel, other metals, composites and combinations thereof that meet or exceed all National Institute of Justice (NIJ) standards (NIJ Standard-0307.01) and testing requirements. According to some of the embodiments, the triple handcuff assembly may have an anodized, black oxide, nickel, rubber, polymer, composite, penetrate, and/or other finish. The handcuffs fold flat for storage, fit over a belt without protruding and fit most standard handcuff cases. The handcuffs can be carried in a standard handcuff case or pouch and work with typical duty belt placement. Still in further exemplary embodiments, the pivot locks 60 help to provide additional security to the lock while preventing the cuffs from tightening. The pivot locking mechanism 60 with the primary locking mechanism 50 function properly when the user double locks the primary lock 50 (i.e. by double locking it prevents the cuff from tightening, this would therefore prevent the pivot lock 60 from tightening since they are connected to the same locking arm 40 but for added security the pivot lock 60 could also be locked separately). However, pivot lock 60 can also include a double locking mechanism similar to primary locking mechanism 50 for additional security.

In further exemplary embodiments, the triple locking handcuffs includes additional markings, differentiating planar colors, or distinguishable indicia (e.g., marking black alphanumeric characters and/or symbols on a white surface) for orientation of the handcuffs. This could be achieved through a variety of methods, such as, for example, handwriting, affixing a computer-generated or handwritten label, thermal printing, etching, painting, or molding a portion of the handcuffs with a portion of a raised surface area or a concave aperture. For example, the marking may be stamped or pressed into a metal. Alternatively, the marking may be accomplished by applying a film, a substrate, magnetic material, or the like to the handcuff.

Yet another embodiment handcuff 230 is illustrated in FIGS. 7-12. Handcuff 230 includes a shackle or body portion 232 that has parallel upper and lower strands 239 and 241 respectively extending therefrom terminating in a pivoting end 238. Body portion houses therein a locking mechanism 250 as the primary lock for the handcuff. Handcuff 230 also had a single strand locking arm 240 that is pivotally attached to upper and lower strands 239, 240 at pivot hinge 246. Locking arm 240 also includes ratcheted teeth 243 along an outer edge for engaging with primary locking mechanism 250. All of these features are well known in handcuff construction and are discussed above. Handcuff 230 further includes an alternate embodiment pivot lock 260.

Figure 7:
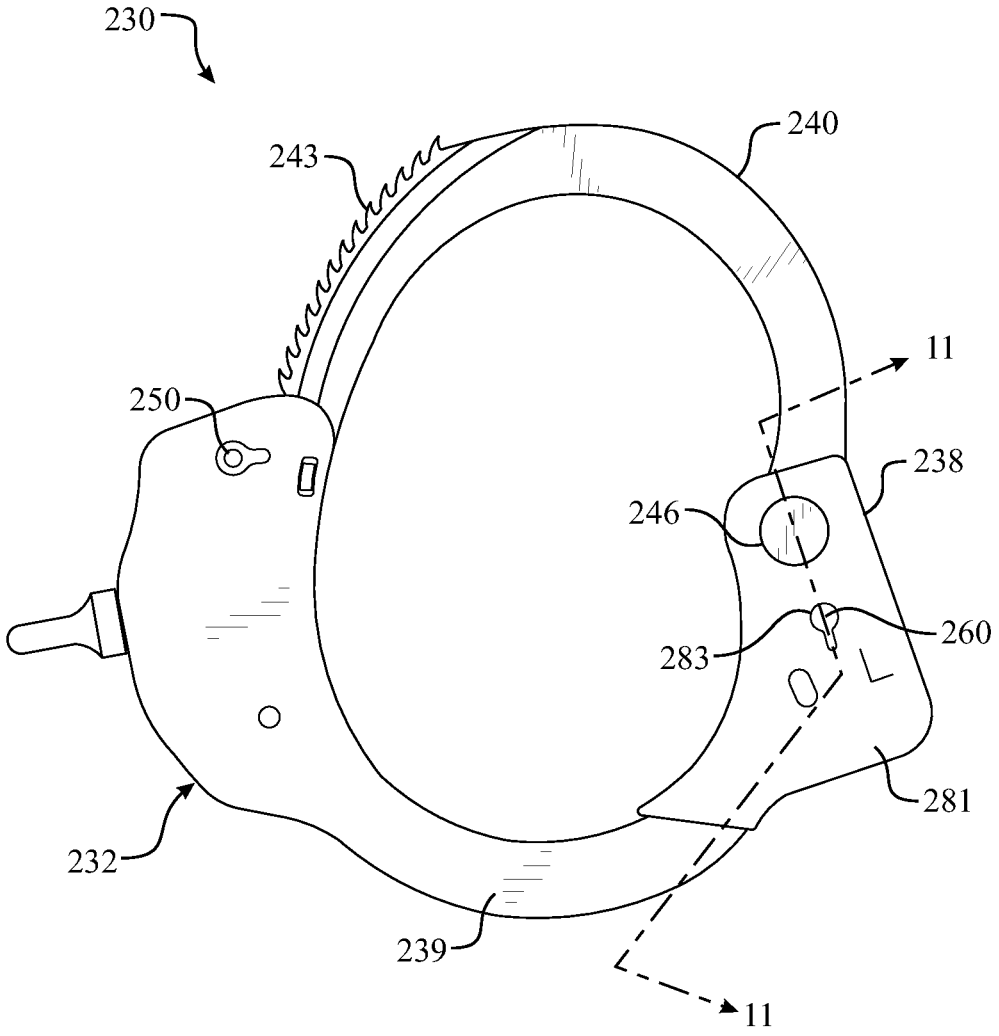
FIG. 7 is a top view of a single cuff incorporating a pivot lock.
Figure 8:
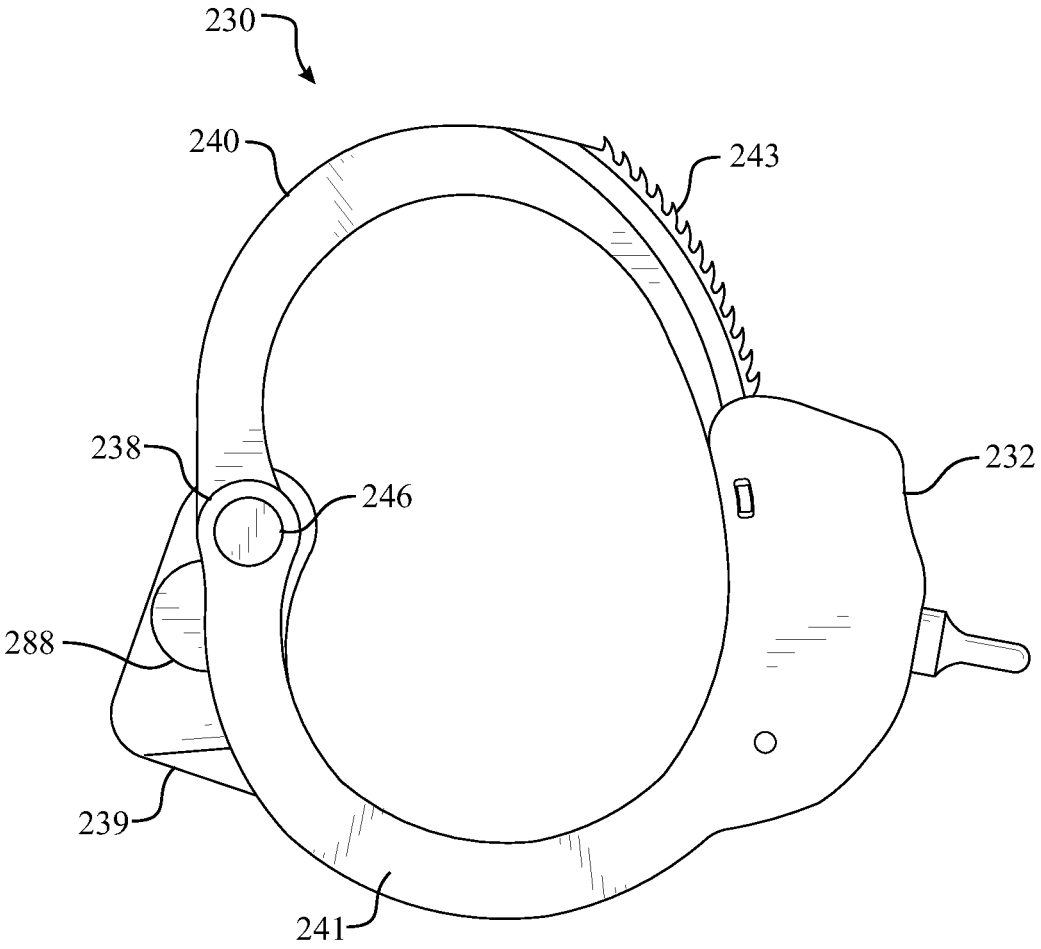
FIG. 8 is a bottom view of the single cuff illustrated in FIG. 7.
Figure 12:
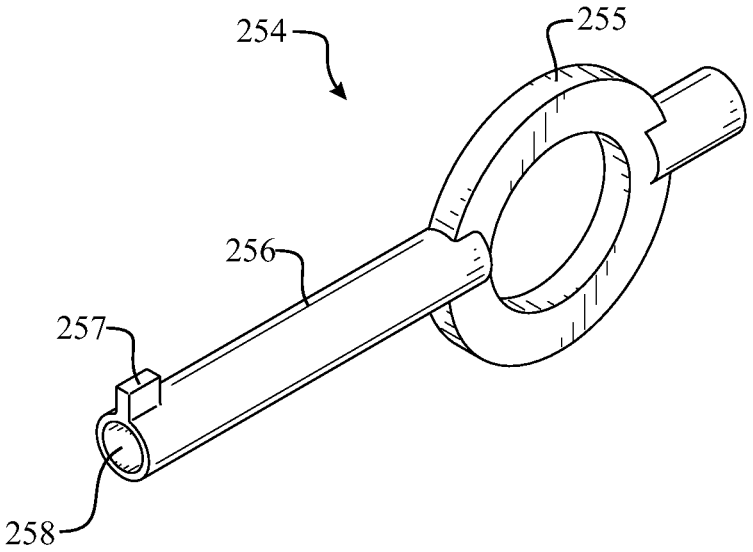
FIG. 12 is a perspective view of a key for unlocking the pivot locking mechanism.

Referring to FIGS. 7-8, upper strand 239 at pivot end 238 is configured to accept the mechanism of pivot lock 260, which is enclosed therein by pivot lock cover 281. Pivot lock cover 281 defines a keyhole for receiving an end of a locking/unlocking key 254 (FIG. 12). The visible surface of cover 281 can also be embossed with an "O" and an "L" to designate the direction in which key 254 is to be turned to 'open' or 'lock' pivot lock 260. The underside of upper strand 239 can also include an access cover 288 to facilitate access to the mechanism of pivot lock 260. The pivot lock cover 281 can be fabricated of a forging, casting, machining, and the like.

Figure 9:
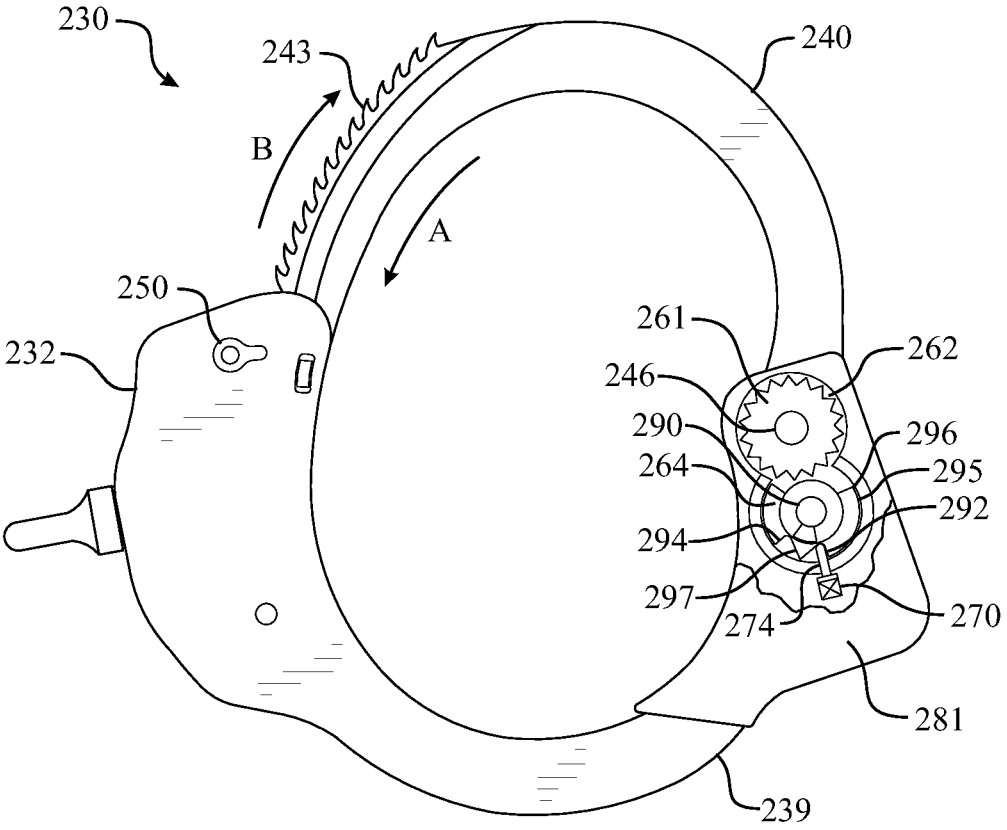
FIG. 9 is a partially segmented top view of the single cuff of FIG. 7 illustrating the pivot locking mechanism in an unlocked state.
Figure 10:
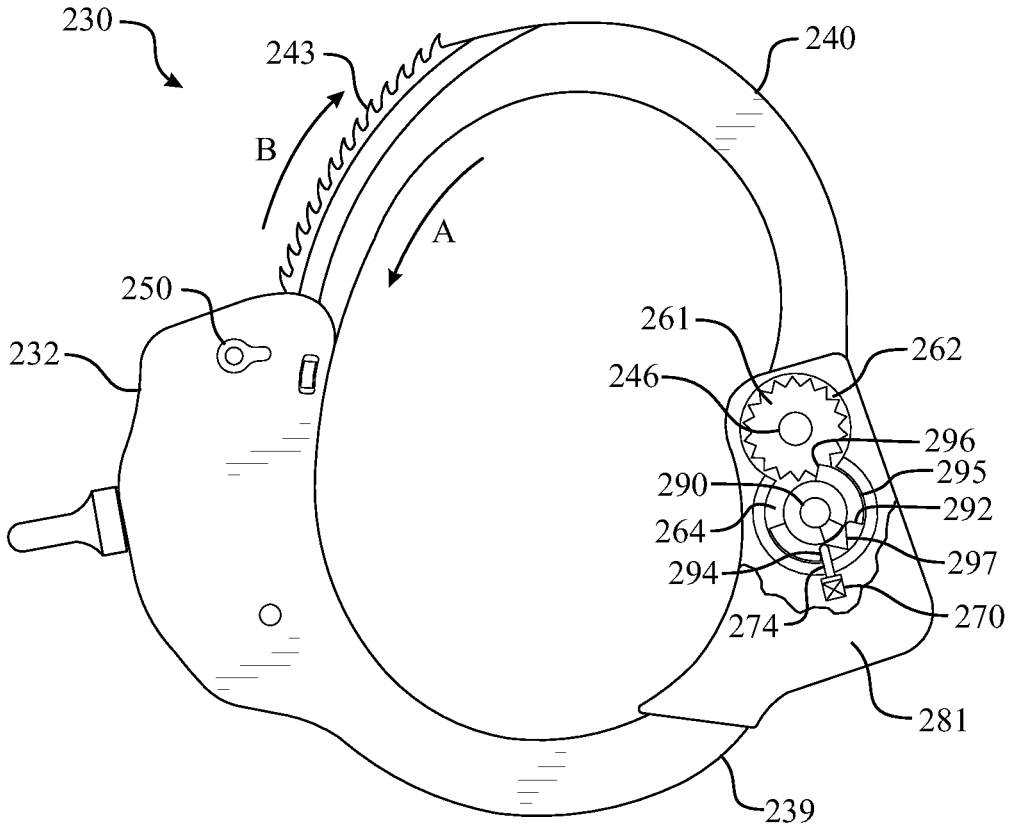
FIG. 10 is a partially segmented top view of the single cuff of FIG. 7 illustrating the pivot locking mechanism in a locked state.
Figure 11:
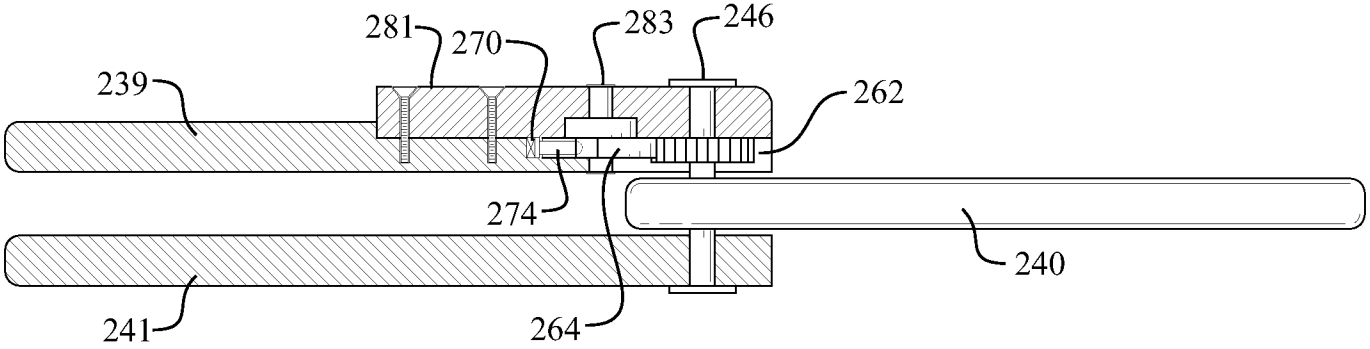
FIG. 11 is an elevation cross-section of the single cuff of FIG. 7 taken along the section line 11-11, FIG. 7.

Pivot locking mechanism 260 is illustrated in FIGS. 9-10 wherein FIG. 9 illustrates the 'open' or unlocked state of handcuff 230, and FIG. 10 illustrates the 'locked' state of handcuff 230. Locking arm 240 has affixed thereto a pivot gear 261. Pivot gear 261 is fixed to locking arm 240 in a stationary manner and positioned to rotate around hinge 246 as locking arm 240 rotates about hinge 246. Pivot gear 261 includes a plurality of uniform triangular teeth 262 positioned about its periphery.

Proximate to pivot gear 261 and coplanar therewith, a locking pawl 264 is rotatably mounted in pivot end 238 of upper strand 239. Locking pawl 264 defines a key recess 290 for receiving therein key 254 by which locking pawl can be rotated in a clockwise (open) or counterclockwise (locked) manner. An upper periphery of locking pawl 264 has a projection 296, here shown as an end of an arcuate guide 295 that is movable into and out of engagement with teeth 262 of pivot gear 261.

A lower periphery of locking pawl 264 defines first and second detents 292, 294 respectively and separated by triangular cam surface 274. An axially movable plunger 274 is biased into engagement with detents 292, 294 by biasing compression spring 270.

In use, and when in an unlocked state as illustrated in FIG. 9, locking pawl is positioned in its clockwise-most position wherein plunger 274 is engaged in first detent 292. Detent 292 is configured such that plunger 272 maintains its clockwise-most position and is completely disengaged from teeth 262 of pivot gear 261. In this 'open' state, locking arm 240 is free to pivot about hinge 246 in either direction 'A' or direction 'B' depending on whether primary lock 250 is in its locked or unlocked state. Incorporation of pivot lock 260 including plunger 272 in combination with locking pawl 264 permits handcuff 230 to be continually cycled forward or completely pushed through strands 239 and 241. Consequently, there is no need to incorporate in lock 260 an additional mechanism to permit resetting of lock 260 as disclosed with respect to pivot locks 60 and 160 as described above.

To lock pivot lock 260, shaft 256 of key 254 (FIG. 12) is inserted in keyhole 283 and rotated counterclockwise with the fingers of a user applying the required rotational force against enlarged portion 255 whereupon blade 257 of key 254 engages locking pawl 264. As key 254 is rotated counterclockwise, locking pawl 264 is likewise rotated and cam 297 axially displaces plunger 274 against the bias of spring 270. Once cam 274 over-centers with respect to plunger 274 biasing spring begins to extend plunger 274 into second detent 294 until locking pawl 264 is in its counterclockwise most position. In this position, projection 296 of locking pawl is in engagement with teeth 262 of pivot gear 261. An advantage of pivot lock 260 is that lock 260 can be left in a locked position and locking arm 240 can still be cycled forward, thereby locking automatically once place on the wrist when left in the locked position. In this manner, the operator does not have to remember to activate pivot lock 260. However, a double locking mechanism can be added to pivot lock 260 locking plunger 274 in place in detent 294 and thereby preventing the cycling or tightening of locking arm 240.

Projection 296 is configured to prevent locking arm 240 from rotating in direction 'B', here shown as teeth 262 bearing against the outer arcuate surface of arcuate guide 295, thus providing a secondary lock in addition to primary lock 250 engaging ratchet teeth 243 on locking arm 240 as illustrated in FIG. 9. However, when locking pawl is in the locked position, locking arm 240 can still be rotated in direction 'A'. As locking arm is rotated in direction 'A', teeth 262 of pivot gear 261 cam against projection 296 and rotate locking pawl 264 in a clockwise direction overcoming the biasing of spring 270 on plunger 274. The camming action of teeth 262 against projection 296 is insufficient to over-center cam 297 thus plunger 274 again fully engages in second detent 294 by the force of biasing spring 270 and maintains pivot lock 260 in its 'locked' state. Pivot lock 260 maintains its 'locked' state until key 254 is again inserted in keyhole 283 and rotated in a clockwise direction until cam 297 again over-centers to engage plunger 274 in first detent 292 to unlock pivot lock 260.

As illustrated in FIG. 12, key 254 can be a known handcuff key configuration having an enlarged portion 255 to which the user's fingers can apply a desired rotational force. A shaft 256 extends therefrom for insertion in keyhole 283 of cuff 230 and has at an end thereof a blade 257 for engaging pawl 264 and transferring the rotational force to pawl 264. A hole or recess 258 can be defined in the end of shaft 256 to receive a pin (not shown) of pivot locking mechanism 260 for proper alignment of key 254 with respect to locking pawl 264.

In one variation of pivot lock 260, lock 260 is held in a fixed locked position by spring tension similar to the existing base plate on known handcuff designs. When the cuffs are opened, the base plate would be held back or opened. Upon removal of the key, the lock mechanism would remain in the locked position. Such a configuration requires that both locks be opened simultaneously to release the cuff from a wrist and thus provide a higher security cuff.

Those practiced in the art will recognize that pivot lock 160 as illustrated in FIG. 6 and pivot lock 260 as illustrated in FIGS. 7-11 permit the cuff to be tightened once the cuff has been positioned on the wearer's wrist. A deadbolt mechanism would not allow tightening and would have to be manually applied or locked once placed in position. A disadvantage of a deadbolt mechanism is that the operator would have to remember to lock the pivot lock. An advantage of the deadbolt mechanism is that it would not require a double locking mechanism as the components would already be locked or held in place when applied and the lack of movement will contribute to strength and longevity.

While FIGS. 7, 9, and 10 illustrate pivot lock 260 as being enclosed in strand 239 with a cover 281 that is held in place with screws, those practiced in the art will readily recognize that other methods such as welding can be utilized to enclose pivot lock 260 within strand 239 as well as incorporating alternate methods of forming the recess in which pivot lock is housed. In an alternative embodiment, the strands 239 can be fabricated having a uniform or unitary construction, thus reducing or eliminating the number of screws.

It is understood that the locking mechanism 250 can utilize the pivot lock 260 can include a section of the pivot gear or ratchet can be designed incorporating a non-engaging section, wherein the pivot gear or ratchet can be cycled between an engaging configuration and an unrestricting configuration oriented enabling unrestricted rotation of the single strand locking arm 240. The locking mechanism 250 can be designed enabling cycling into a locked configuration only upon insertion of the single strand locking arm 240 therein.

This feature ensures that the pivot lock 260 engages only when the cuff is closed. A benefit of this feature is appreciated when subjected to a scenario wherein the prisoner is resisting arrest. The unrestricted motion of the cuff enables the office to rotate the single strand locking arm 240 in either direction. This eliminates the requirement that the officer cycle the single strand locking arm 240 through the locking configuration and fully around to a staged configuration. Essentially, the rotation of the single strand locking arm 240 can be reduced to a small opening rotational motion (such as 5-20 degrees), compared to a nearly complete circular motion (such as 340-355 degrees). When trying to cuff a resisting prisoner that is physically restrained (such as a condition where the prisoner is restrained on the ground, against a wall or against another fixed object) it may not be possible to cycle the single strand locking arm 240 through due to position or space constraints.

It would be desired that the handcuff is placed upon a prisoner having the pivot lock 260 directed on the upside of the prisoner. This orients the keyway in a position that is readily visible and accessible to the operator to easily operate and open the handcuffs 230 and remove them from the prisoner.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

What is claimed is:

1. A method of operating a safety locking handcuff assembly comprising steps of:

obtaining said safety locking handcuff assembly, said safety locking handcuff assembly comprising:

a pair of handcuff bodies retained to one another by one or more linkages, each handcuff body extending between a body pivot end and a body latching end, a locking arm extending between a locking arm latching end and a locking arm pivot end, said locking arm pivot end being pivotally assembled to said handcuff body pivot end, a latching feature integrated into each locking arm proximate said locking arm latching end, a first locking mechanism integrated into each handcuff body proximate said body latching end, wherein said first locking mechanism is operated by a first key, which alternates said first locking mechanism between an engaged configuration and a disengaged configuration respective to said locking arm latching feature, and a second locking mechanism integrated into each handcuff body proximate said body pivot end, wherein said second locking mechanism is operated by a second key, which alternates said second locking mechanism between an engaged configuration and a disengaged configuration respective to said locking arm pivot end, rotating said locking arm separating said locking arm latching end from said body latching end;

placing a object between said handcuff body and said locking arm in a manner to be retained therebetween when said safety locking handcuff assembly is placed into a locked configuration;

operating said first key engaging said first locking mechanism with said locking arm latching feature to retain said locking arm latching end in mechanical communication with said body latching end; and operating said second key engaging said second locking mechanism with said locking arm pivot end to retain said locking arm from rotating.

2. A method of operating a safety locking handcuff assembly as recited in claim 1, said method further comprising a step of utilizing one key for both said first key operation and said second key operation.

3. A method of operating a safety locking handcuff assembly as recited in claim 2, said step of operating said first key is accomplished by rotating said first key and said step of operating said second key is accomplished by rotating said second key.

4. A method of operating a safety locking handcuff assembly as recited in claim 1, said step of operating said first key is accomplished by rotating said first key and said step of operating said second key is accomplished by rotating said second key.

5. A method of operating a safety locking handcuff assembly as recited in claim 1, said step of engaging said second locking mechanism with said locking arm pivot end to retain said locking arm from rotating is accomplished by engaging locking teeth of said second locking mechanism with mating teeth integrated into said locking arm pivot end to retain said locking arm from rotating.

6. A method of operating a safety locking handcuff assembly as recited in claim 1, said step of engaging said second locking mechanism with said locking arm pivot end to retain said locking arm from rotating is accomplished by engaging ratcheting teeth of said second locking mechanism with ratcheting teeth integrated into said locking arm pivot end to retain said locking arm from rotating in an opening direction while enabling rotation of said locking arm in an locking direction via a ratcheting interface formed between said second locking mechanism ratcheting teeth and said locking arm pivot end ratcheting teeth.

7. A method of operating a safety locking handcuff assembly as recited in claim 1, said step of engaging said first locking mechanism with said locking arm latching end to retain said locking arm in mechanical communication with said body latching end is accomplished by engaging said first locking mechanism with a series of latching end ratcheting teeth formed about at least a portion of said locking arm retaining said locking arm from rotating in an opening direction while enabling rotation of said locking arm in a locking direction via a ratcheting interface formed between said first locking mechanism and said series of locking arm latching end ratcheting teeth.

8. A method of operating a safety locking handcuff assembly comprising steps of:

obtaining said safety locking handcuff assembly, said safety locking handcuff assembly comprising:

a pair of handcuff bodies retained to one another by one or more linkages, each handcuff body extending between a body pivot end and a body latching end, a locking arm extending between a locking arm latching end and a locking arm pivot end, said locking arm pivot end being pivotally assembled to said handcuff body pivot end, a series of latching teeth extend along a portion of each locking arm proximate said locking arm latching end, a first locking mechanism integrated into each handcuff body proximate said body latching end, wherein said first locking mechanism is operated by a first key, which alternates said first locking mechanism between an engaged configuration and a disengaged configuration respective to said latching feature, and a second locking mechanism integrated into each handcuff body proximate said body pivot end, wherein said second locking mechanism is operated by a second key, which alternates said second locking mechanism between an engaged configuration and a disengaged configuration respective to said locking arm pivot end, rotating said locking arm separating said locking arm latching end from said body latching end;

placing a object between said handcuff body and said locking arm in a manner to be retained therebetween when said safety locking handcuff assembly is placed into a locked configuration;

operating said first key engaging said first locking mechanism with said latching feature to retain said locking arm latching end in mechanical communication with said body latching end; and operating said second key engaging said second locking mechanism with said locking arm pivot end to retain said locking arm from rotating.

9. A method of operating a safety locking handcuff assembly as recited in claim 8, said method further comprising a step of utilizing one key for both said first key operation and said second key operation.

10. A method of operating a safety locking handcuff assembly as recited in claim 9, said step of operating said first key is accomplished by rotating said first key and said step of operating said second key is accomplished by rotating said second key.

11. A method of operating a safety locking handcuff assembly as recited in claim 8, said step of operating said first key is accomplished by rotating said first key and said step of operating said second key is accomplished by rotating said second key.

12. A method of operating a safety locking handcuff assembly as recited in claim 8, said step of engaging said second locking mechanism with said locking arm pivot end to retain said locking arm from rotating is accomplished by engaging locking teeth of said second locking mechanism with mating teeth integrated into said locking arm pivot end to retain said locking arm from rotating.

13. A method of operating a safety locking handcuff assembly as recited in claim 8, said step of engaging said second locking mechanism with said locking arm pivot end to retain said locking arm from rotating is accomplished by engaging ratcheting teeth of said second locking mechanism with ratcheting teeth integrated into said locking arm pivot end to retain said locking arm from rotating in an opening direction while enabling rotation of said locking arm in a locking direction via a ratcheting interface formed between said second locking mechanism ratcheting teeth and said locking arm pivot end ratcheting teeth.

14. A method of operating a safety locking handcuff assembly as recited in claim 8, said step of engaging said first locking mechanism with said locking arm latching end to retain said locking arm in mechanical communication with said body latching end is accomplished by engaging said first locking mechanism with a series of latching end ratcheting teeth formed along at least a portion of said locking arm retaining said locking arm from rotating in an opening direction while enabling rotation of said locking arm in a locking direction via a ratcheting interface formed between said first locking mechanism and said series of locking arm latching end ratcheting teeth.

15. A method of operating a safety locking handcuff assembly comprising steps of:

obtaining said safety locking handcuff assembly, said safety locking handcuff assembly comprising:

a pair of handcuff bodies retained to one another by one or more linkages, each handcuff body extending between a body pivot end and a body latching end, a locking arm extending between a locking arm latching end and a locking arm pivot end, said locking arm pivot end being pivotally assembled to said handcuff body pivot end, a series of linear retaining latching teeth extending along at least a portion of each locking arm proximate said locking arm latching end, a series of pivot retaining latching teeth extending at least partially around said locking arm pivot end, a first locking mechanism integrated into each handcuff body proximate said body latching end, wherein said first locking mechanism is operated by a first key, which alternates said first locking mechanism between an engaged configuration and a disengaged configuration respective to said latching feature, and a second locking mechanism integrated into each handcuff body proximate said body pivot end, wherein said second locking mechanism is operated by a second key, which alternates said second locking mechanism between an engaged configuration and a disengaged configuration respective to said pivot retaining latching teeth, rotating said locking arm separating said locking arm latching end from said body latching end;

placing a object between said handcuff body and said locking arm in a manner to be retained therebetween when said safety locking handcuff assembly is placed into a locked configuration;

rotating said first key engaging said first locking mechanism with said latching feature retaining said locking arm latching end in mechanical communication with said body latching end; and rotating said second key engaging said second locking mechanism with said pivot retaining latching teeth retaining said locking arm from rotating.

16. A method of operating a safety locking handcuff assembly as recited in claim 15, said method further comprising a step of utilizing one key for both said first key operation and said second key operation.

17. A method of operating a safety locking handcuff assembly as recited in claim 15, said step of engaging said second locking mechanism with said locking arm pivot end retaining said locking arm from rotating is accomplished by engaging locking teeth of said second locking mechanism with mating teeth integrated into said locking arm pivot end retaining said locking arm from rotating.

18. A method of operating a safety locking handcuff assembly as recited in claim 15, wherein said pivot retaining latching teeth are formed as ratcheting teeth and said step of engaging said second locking mechanism with said locking arm pivot end to retain said locking arm from rotating is accomplished by engaging ratcheting teeth of said second locking mechanism with said pivot retaining ratcheting teeth, retaining said locking arm from rotating in an opening direction while enabling rotation of said locking arm in a locking direction via a ratcheting interface formed between said second locking mechanism ratcheting teeth and said locking arm pivot end ratcheting teeth.

19. A method of operating a safety locking handcuff assembly as recited in claim 18, wherein said linear retaining latching teeth are formed as ratcheting teeth and said step of engaging said first locking mechanism with said locking arm latching end to retain said locking arm in mechanical communication with said body latching end is accomplished by engaging said first locking mechanism with said series of linear retaining ratcheting teeth, retaining said locking arm from rotating in an opening direction while enabling rotation of said locking arm in a locking direction via a ratcheting interface formed between said first locking mechanism and said series of linear retaining ratcheting teeth.

20. A method of operating a safety locking handcuff assembly as recited in claim 15, wherein said linear retaining latching teeth are formed as ratcheting teeth and said step of engaging said first locking mechanism with said locking arm latching end to retain said locking arm in mechanical communication with said body latching end is accomplished by engaging said first locking mechanism with said series of linear retaining ratcheting teeth, retaining said locking arm from rotating in an opening direction while enabling rotation of said locking arm in a locking direction via a ratcheting interface formed between said first locking mechanism and said series of linear retaining ratcheting teeth.

* * * * *